US006547110B2

(12) United States Patent
O'Hare

(10) Patent No.: US 6,547,110 B2
(45) Date of Patent: Apr. 15, 2003

(54) UNIVERSAL BACK PACK AND LOUNGE SEAT COMBINATION

(76) Inventor: Daniel P. O'Hare, 1 Princeton Ave., Fort Mitchell, KY (US) 41017

( * ) Notice: Subject to any disclaimer, the term of this patent is extended or adjusted under 35 U.S.C. 154(b) by 0 days.

(21) Appl. No.: 09/759,614

(22) Filed: Jan. 12, 2001

(65) Prior Publication Data

US 2002/0023937 A1 Feb. 28, 2002

Related U.S. Application Data

(60) Provisional application No. 60/176,378, filed on Jan. 14, 2000.

(51) Int. Cl.[7] ..... A45F 4/02

(52) U.S. Cl. ..... 224/155; 224/156; 224/628; 224/652; 224/654; 224/658; 224/659; 297/129

(58) Field of Search ..... 224/153, 155, 224/156, 627, 628, 629, 630, 650, 652, 654, 655, 658, 659; 297/129; 190/127

(56) References Cited

U.S. PATENT DOCUMENTS

| | | | | | |
|---|---|---|---|---|---|
| 3,622,056 | A | * | 11/1971 | Droeger | 224/153 |
| 3,730,294 | A | * | 5/1973 | Thurmond | 182/187 |
| 4,410,214 | A | * | 10/1983 | Geschwender | |
| 4,720,029 | A | * | 1/1988 | Varanakis | 224/155 |
| 4,809,893 | A | * | 3/1989 | Parsons | 224/261 |
| 5,289,958 | A | * | 3/1994 | Jay | 224/153 |
| 5,439,153 | A | * | 8/1995 | Murdoch et al. | 150/159 |
| 5,465,425 | A | * | 11/1995 | Crispin | 2/102 |
| 5,588,570 | A | * | 12/1996 | Zirbel | 224/155 |
| 5,779,121 | A | * | 7/1998 | Capwell | 224/655 |
| 5,819,999 | A | * | 10/1998 | Tennant | 224/153 |
| 6,036,067 | A | * | 3/2000 | Alcorn | 206/315.11 |
| 6,145,716 | A | * | 11/2000 | Caicedo | 224/155 |

FOREIGN PATENT DOCUMENTS

| | | | | |
|---|---|---|---|---|
| AT | 149560 | * | 5/1937 | 224/210 |
| FR | 942623 | * | 2/1949 | 224/210 |
| FR | 1354399 | * | 1/1964 | 224/210 |
| FR | 2579875 A | * | 10/1986 | 224/209 |
| NO | 71207 | * | 1/1944 | 224/209 |

* cited by examiner

*Primary Examiner*—Nathan J. Newhouse
(74) *Attorney, Agent, or Firm*—Wood, Herron & Evans LLP

(57) ABSTRACT

An improved backpack includes two capacious storage pockets secured to a flexible envelope for retaining a frame. A seat pad is adjustable between three positions for carrying, to provide seated cushioning and to provide recline support. Side pockets on the pack open upwardly and forwardly with respect to a user for carry, seated and recline positions of the backpack, in whichever orientation it is placed. A plurality of support straps carry partial weight of stored items to the top area and shoulder straps of the pack. A roll down, hunter orange panel is selectively concealed or unfurled for safety.

8 Claims, 6 Drawing Sheets

UNIVERSAL BACK PACK AND LOUNGE SEAT COMBINATION

Applicant claims the benefit of the priority of its United States Provisional Patent Application Ser. No. 60/176,378, filed Jan. 14, 2000, such application expressly incorporated herein by reference in its entirety.

This invention relates to a multi-purpose storage and carry pack which incorporates an internal frame and serves as a combination backpack and lounge to support an upright seated position and a lying down or reclined position. The main application is for hunting of turkey and geese, but the invention has numerous other applications.

Hunters of the above-mentioned particular species have a requirement for large, multi-purpose carrying packs with storage space for storing accessories needed in the various hunting endeavors. There are gaps in the current products offered on the market today. A typical pack incorporates a hunting vest with large and small pockets. Some may even provide a cushion to be used when in a seated position. Others support to provide the multiple functions of pack, seat and tree stand. With all of this, there still seems to be missing a key element of universal storage for larger items and proper support of the body ergonomically in a variety of positions. There is thus a gap for the aging hunter and the individual who seeks comfort while in a seated or reclined position for an extended period of time. There is also a gap between the desire on one hand for a supportive seat and, on the other hand, the weight and awkwardness of prior devices, chairs, etc.

Several manufacturers provide hunting packs and several patents disclose them, however, there are none known that incorporate a multifunctional pack which can be configured for use as a seated body support and a lying down or reclined head and neck support.

It is desired to provide a specially-designed carry pack which can be configured as a support that can be suited for multi-purpose hunting and hunting postures.

It is thus one objective of the invention to provide a multiple function pack and lounge for storing and carrying items, for providing a seat and for providing a lounge for a reclining user.

It is another objective of the invention to provide a pack having adequate storage of items needed in the field while hunting. The storage would include, but not be limited to, game calls, clothing, decoys, gun shells, etc. this storage should be specially designed for both ergonomically placed positions and size for easy and adequate access and capacity.

A further objective of the invention is to provide a pack in combination with an internal frame that is specially designed to provide proper ergonomic body support and comfort for multiple seating and reclining positions. This frame can be broken down into compact form for transport and stowing away. This frame also serves universal purposes for support of two body postures: upright seated positions and lying down positions.

A further objective of the invention is to incorporate "D" rings specifically located to support game hooks designed to mount game birds and transport them out of the field. These "D" rings are to be located on the frame of the pack in order to use the frame of the pack to distribute the weight of the game proportionately through the frame.

A further objective of the invention is to provide a roll-up hunter's orange protection panel designed to be unveiled when exiting the field. This orange would be of the legal requirement of size, dimension and color to meet the laws and regulations set by state governments. This roll-up orange panel would also incorporate camouflage trim to conceal the orange from wary game once rolled up in the closed position, such as while hunting.

A further objective of the invention is to provide a seat cushion for use by hunters and sportsmen and designed to provide comfort in a seated position. This cushion would also be designed to support the head and shoulders once oriented into a recline position. This cushion would provide reduction in the uncomfortable sensation of underlying roots, rocks etc. while the user is seated or reclined.

SUMMARY OF THE INVENTION

The present invention contemplates a combined backpack, configurable for lounge and seat operation. This invention has several features, including storage compartments, both large and small, along with an internal frame to provide for universal seated and recline positions. This backpack and lounge combination is ergonomically designed to support the body in the upper shoulder and lateral area as well as the lower lumbar and buttock area in a seated position, and the head and shoulders in a recline position. This invention was designed with universal use in mind. The product features were originally designed for the hunting industry, however, the invention has cross-functional applications to the college student, camper, hiker, beach bum and others.

According to the invention, in one embodiment, the pack uses an internal frame, such one of the frames described in U.S. Pat. Nos. 4,208,070; 4,410,214 and Des. 259,752. Each of these patents is expressly incorporated herein by reference, and copies are submitted and filed herewith as a part hereof as if fully and expressly incorporated herein. The pack incorporates an envelope for receiving the frame in a floating pocket. Even though this pocket was not necessarily designed for storage, it can also be used to support the components of a portable blind that is under development for the waterfowl hunter, or spacers and other materials. More particularly, the backpack includes a frame pocket with a plurality of storage pockets sewn or attached thereto.

One additional very large inner storage pocket carries very large gear, such as clothing, decoys, etc. This pocket has a strong weather-resistant zipper. The zipper is designed on an angle down each side. This enables the mouth of the pocket to open very wide to avoid "cramming or stuffing" the gear through a small opening. This pocket zipper has a rain flap to cover the entire zipper.

The second, medium-size outer pocket accommodates storage of other items, such as thermos, box of shells and more. This pocket has a one inch Velcro® strip on the associated overflap to secure and close the opening to keep smaller items from falling out. In addition, two pull straps/clips allow large items to be stored and yet hold the flap in place when the Velcro® will not hold by itself.

There are two doubled or superposed lay pockets located on each side of the pack. These pockets have a specific and unique design. They take ergonomics into account, both in the design and size of the pockets, as well as the angle in which they are sewn. It is this angle that makes them unique. Whether the pack is in the upright seated position or flipped over for the recline position, the pockets remain generally on the same angle, opening toward and easily accessible by the user. This allows the user to reach into the pockets while the pack is on their back, flipped over to support the user in a reclined position, or configured to support the user in a seated position. These pockets utilize snaps or any other suitable fasteners to hold associated flaps in place.

Additional storage can be managed through the use of several strategically-placed "D" rings. A first pair of "D" rings is placed at the top of the pack near respective finger pull straps for holding rolled up items such as tents, clothing, pads, maps etc. These rings could also serve to secure the gap of the pocket that supports the frame.

This becomes important when heavy gear is placed in the large storage compartment. Two "D" rings are placed on the side of the pack at the top of the frame. These rings are to be used for game hook or other accessories. Lastly, four "D" rings are placed at the bottom of the pack, two along the shorter frame. These rings are used for adding straps to hold heavy gear into place and tight to the frame when packing.

The storage compartments accommodate large items such as clothing, waders, decoys, portable blinds and more. Smaller items can also be accommodated with ergonomically-designed pockets to handle gear such as game calls, shotgun shells, thermos, drink bottles, gloves etc. The side pockets are designed on an angle for proper access from standing, seated, or reclined positions.

An angle-shaped wedge cushion of dense foam of any suitable manufacture is incorporated into the seat pocket to allow for comfortable sitting for extended periods of time. This wedge is slipped into place through the frame pocket in which the frame is, again, free floating. This foam is made of very dense material to keep from feeling the bumps, roots and rocks on the ground when seated. There is at least one buckle or clip at each end of the seat pocket and at the end of the envelope surrounding the small frame to enable the seat to be clipped up and under the pack, away from the user's legs when walking.

The pack also introduces a roll-down hunter's orange flap or panel that has Velcro® hook and loop fastener at each end to hold the flap into place when traveling about the woods. This flap has a camouflage selvage or edge sewn onto the orange flap to completely conceal the orange when rolled up and snapped into place. The panel can be unfurled to expose the orange when the safety of that visibility is desired.

Several accessories enhance the function of the basic pack and make the pack more versatile in its use. The game hook has a keyhole-shaped wire that is large and round at one end and tapers to the opposite end. This allows for insertion of the game birds' head in the large opening, from where it slides down and wedges in the tapered portion for carrying. The game hook also utilizes a sewn webbing and hook or clip that attaches to the "D" rings.

The pack can be used alone or in conjunction with a watertowl blind which enhances the use of the backpack for universal waterfowl use. One blind first incorporates a drop cloth of tarp or waterproof material cut in the shape of the human body and designed to fit within typical field corn rows. The drop cloth has a clip placed in the top and center of the drop cloth the allow the pack to clip into place with a releasable buckle secured to the pack. At each of the found ends of the drop cloth, grommets are placed to allow fiberglass poles to be positioned to support the camouflage cover at different heights and angles. There is a clip (female) at the end to enable the camouflage cover clip to be locked into place on the pack and secured in the wind. Fiberglass and shock cord tent poles such as standard tent poles support the cover and flex to create the structure of the camouflage cover. The camouflage cover preferably incorporates three-dimensional, leafy material to allow the hunter to see through the material at the waterfowl from above.

In another aspect of the invention, a retractable or flip-top camouflage cover is used over the backpack and lounge. It is spring biased so on release it retracts or flips up to uncover a hunter for shooting. In another embodiment, a spring biased two piece clamshell-like cover or cabana is used to cover the hunter. It is selectively retractable for entry/exit and for shooting.

Figure 1:
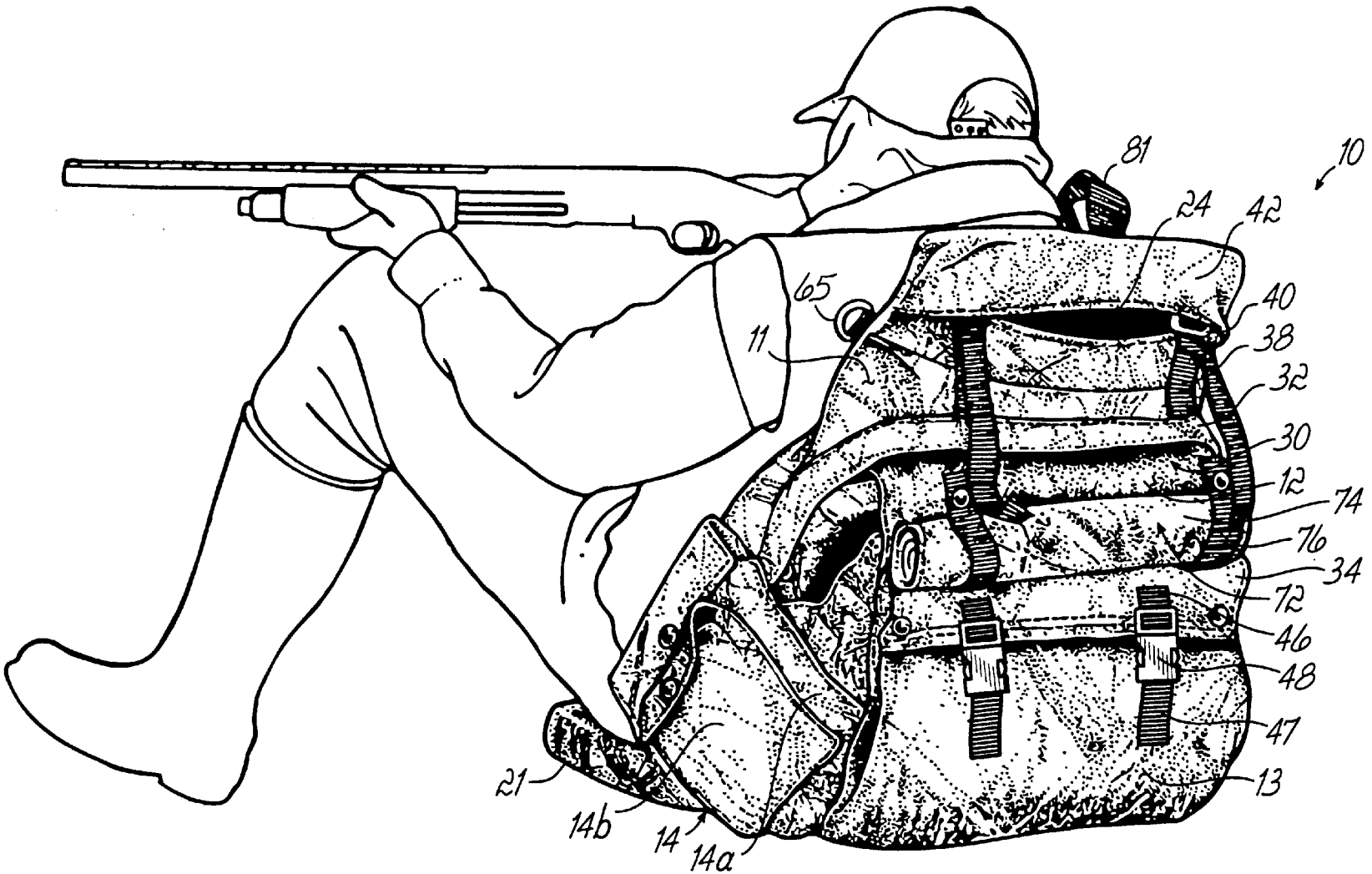
FIG. 1 is a line illustration of the backpack lounge, in use for supporting a seated hunter.

Turning now the drawings, there is disclosed a pack 10 according to the invention.

In particular, frame 16 has an upper U-shaped frame component 18, a lower U-shaped frame component 17, and two curved connectors, 19, 20 for respectively securing ends of frame components 17, 18 to form an erected frame 16. In this regard, frame components 17, 18 are preferably hollow aluminum tubes and connectors 19, 20 serve as curved mandrels, fitting preferably within the tubes of components 17, 18 to join them together in a position where the component 18 forms an included angle in the preferred range less than 90 degrees to more than 60 degrees with component 17. Frame 16 is like that frame particularly disclosed in U.S. Pat. No. 4,410,214, expressly incorporated herein by reference.

Figure 2:
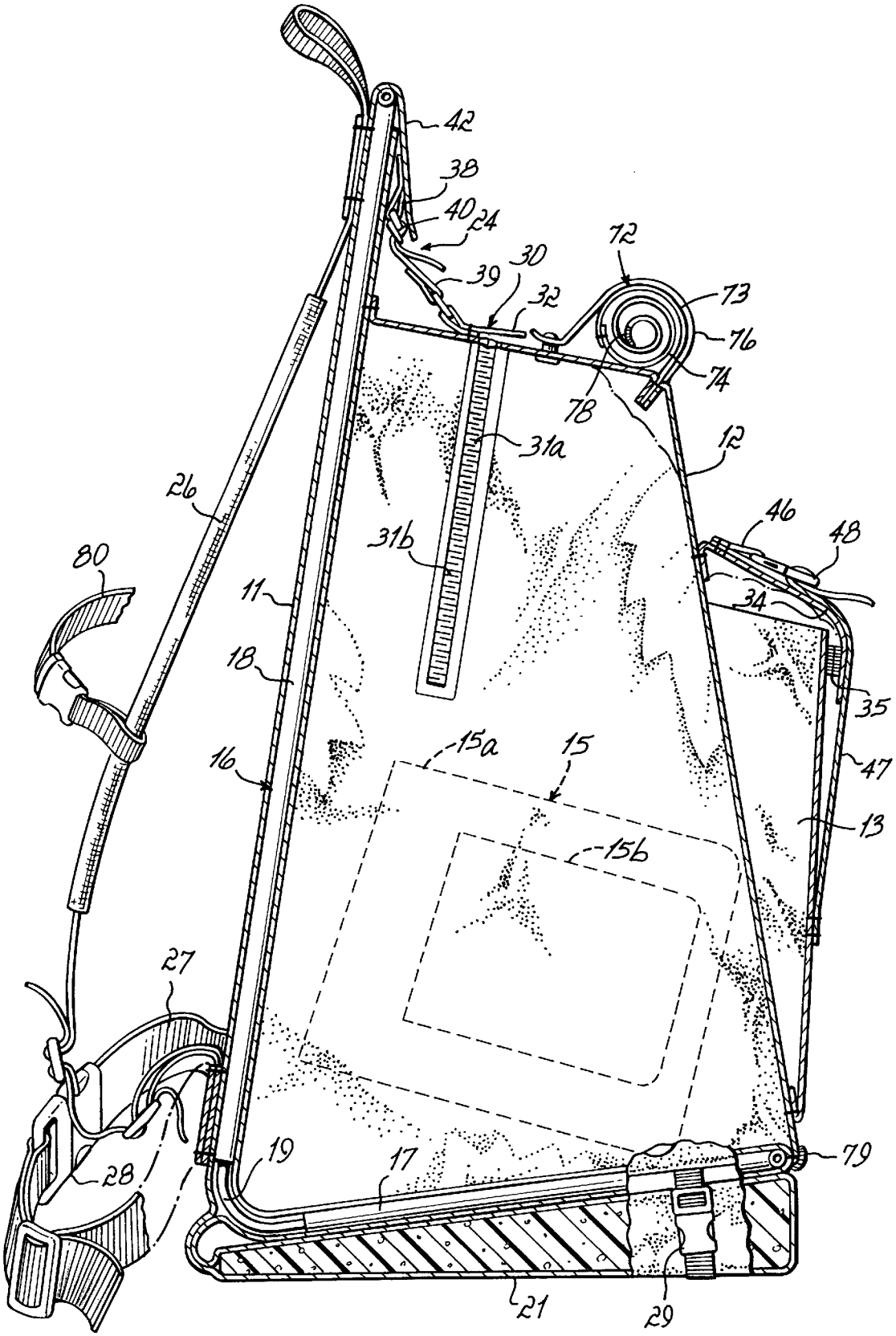
FIG. 2 is a cross-sectional illustration of components of the investigation.

Thus, it will be appreciated that the frame used in the backpack has an upper U-shaped end 18 parallel to the back of a user (see FIGS. 1 and 5) and a lower U-shaped end 17 at an angle to the back of the user extending rearwardly and under the body of backpack 10. The lower U-shaped end 17 thus resides along the ground contour when the user is seated and the invention is used as a seat (see FIG. 1 and 2). It provides, with the upper U-shaped end 18, a back support with the seat pad 21 extending forwardly (FIGS. 1 and 2). The angle of the upper frame end 18 to the lower frame end 17 is preferably about 60 to 90 degrees or any other suitable angle.

Figure 3:
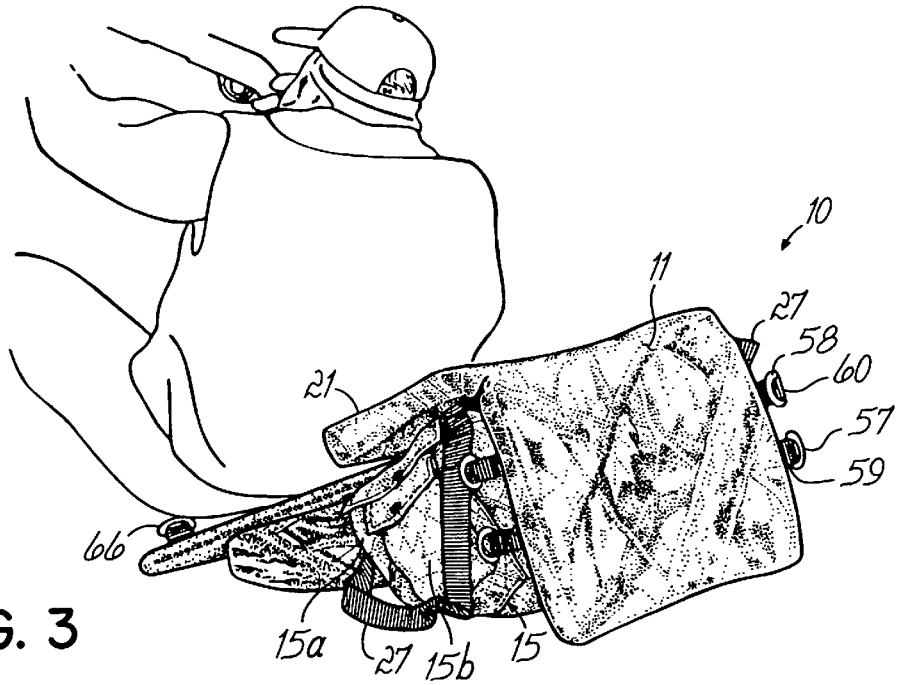
FIG. 3 is a perspective view of the backpack of FIG. 1, but configured in a recline position to support a reclined hunter, with the seat pad flipped up adjacent to the backpack surface normally against the hunter's back when the pack is carried (the hunter being shown in a raised position from the reclining pack for shooting)
Figure 4:
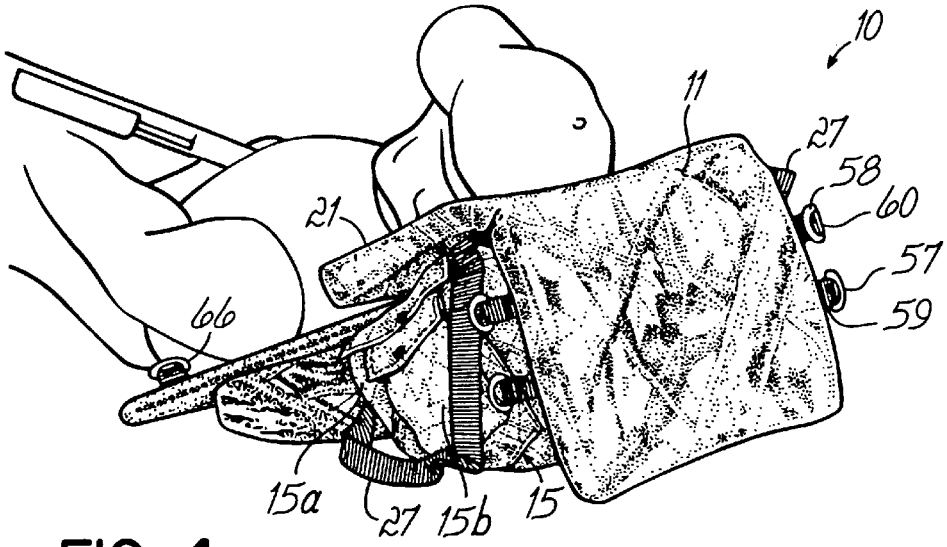
FIG. 4 is side elevational view showing a reclining hunter supported by the pack.

When the backpack is oriented for use in a recline position (see FIGS. 3 and 4) the lower U-shaped frame end 17 is directed upwardly and the upper U-shaped end 18 is disposed at an angle (within the backpack) supporting the back, shoulders and head of a reclining hunter. In this position, the seat pad 21 is oriented along the upper U-shaped frame end 18 to cushion the hunter's back, shoulders and head.

In use, frame component 17 is inserted, closed end first, into envelope 11 through an envelope opening 24. Connectors 19, 20 are then inserted into the open ends of component 17 and component 18 is attached to connectors 19, 20 to form an included angle of about 60 degrees or slightly more to about 90 degrees or slightly less, with component 17. The envelope 11 is pulled up around frame component 18 and the opening 24 closed to secure assembled, form holding frame 16 in envelope 11 and pack 10 to give it the form as shown. As such, frame component 17 extends under the pack 10 (in envelope 11) and beneath packets 12, 13 while component 18 extends upwardly in envelope 18.

Figure 7:
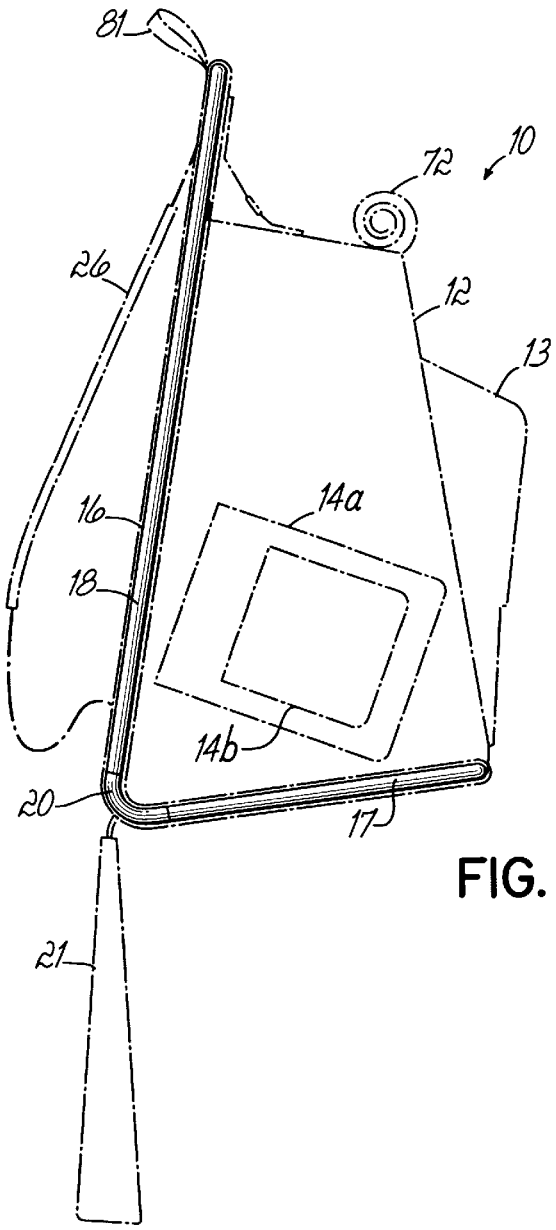
FIG. 7 is a schematic side elevational view of the pack of FIG. 5, showing the pack details in relation to the internal frame.
Figure 8:
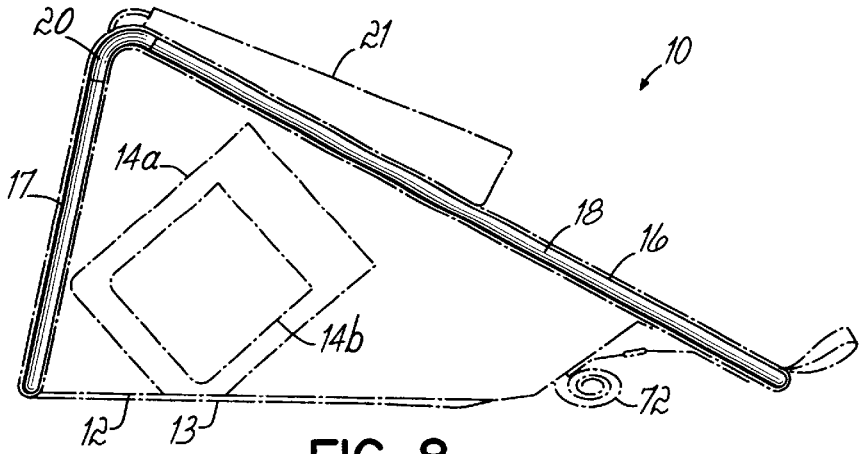
FIG. 8 is a schematic side elevational view of the pack of FIG. 3, showing the pack details in phantom in relation to the internal frame.
Figure 9:
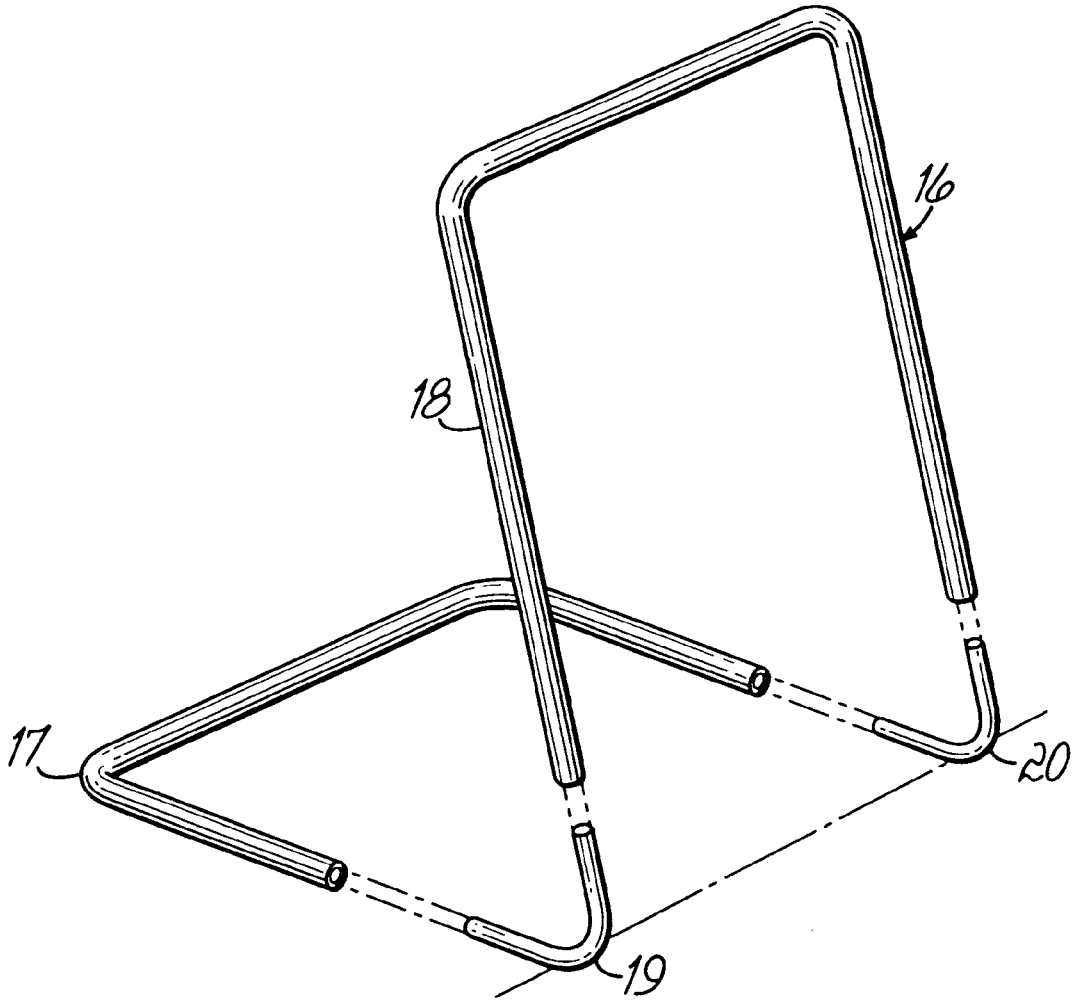
FIG. 9 is a perspective exploded view of the internal frame used in the invention.

When worn, the pack fits on the back of the hunter and is held by straps 26 (FIGS. 5 and 7) and waistband 27, secured by an adjustable buckle 28. Frame component 18 is oriented along the back of a user. Seat 21 is shown loose, but is provided with releasable buckle 29 or other suitable fasteners on each side for securing it in a raised position beneath frame component 17 and pockets 12 and 13.

The overall construction of the backpack 10 is perhaps best viewed in the broken or cross-sectional view of FIG. 2. It will be appreciated that the various pockets described comprise storage areas in the pack 10 comprised by pack material sewn onto or integral with envelope 11 enveloping frame 16. Envelope 11 holds frame 16 (17, 18, 19 and 20) in free floating position and is made preferably of the same material as the remainder of the backpack 10, although it can be any suitable material of durable nature. Inner pocket 12 is sewn or attached onto envelope 11 and is accessed by a wide opening 30, defined by an elongated zipper 31*a*, 3*b* covered by protective weather flap 32.

Outer pocket 13 is sewn onto pocket 12 and is accessed by a flap 34, secured by any suitable fastener such as a hook and loop fastener 35.

Various straps and releasable buckles of well known synthetic material are used to cinch up and strengthen the pockets 12, 13. For example, two strap sets (one shown) at 38, 39 and buckle 40 secure flap 42 of envelope 11 to the top portion 43 of packet 12. Two strap sets (one shown at 46, 47) and buckles 48 secure flap 34 of pocket 13 to the outside of pocket 13. Thus, by connecting and cinching up straps 38, 39 and 46, 47, lifting force is transferred to the top area and flap 42 of envelope 11 so that weight of the items in pockets 12, 13 is partially secured and transferred to the top flap 42 of envelope 11, and this to the tops of shoulder straps 26. Straps 46, 47 also facilitate the security of the hook and loop fastener between flaps 34 and pocket 13.

D-rings 57, 58 are attached by straps 59, 60 to the material of pocket 12, and/or envelope 11 for locking additional items to the pack.

One feature of the invention is the slanted orientation of pockets 14*a*, 14*b* (collectively 14) and 15*a* and 15*b* (collectively 15) on respective sides of pack 10. Pockets 14, 15 are respectively closed by associated flaps and snaps. Note in FIGS. 1 and 2 that when pack 10 is configured in a seating mode, the pockets slant upwardly and forwardly on the pack 10 toward the user. From there, they can be easily accessed by the user and by his hand and arm on the same side, or by this other offside hand and arm with only a small repositioning twist of the body. Flaps on each pocket are snapped and provided with hook and loop or other suitable releasable fasteners.

Likewise, even though wholly reoriented when configured for the recline position (FIGS. 3 and 4), pockets 14, 15 also slant upwardly and forwardly toward the user so that they are easily accessible by him.

Figure 5:
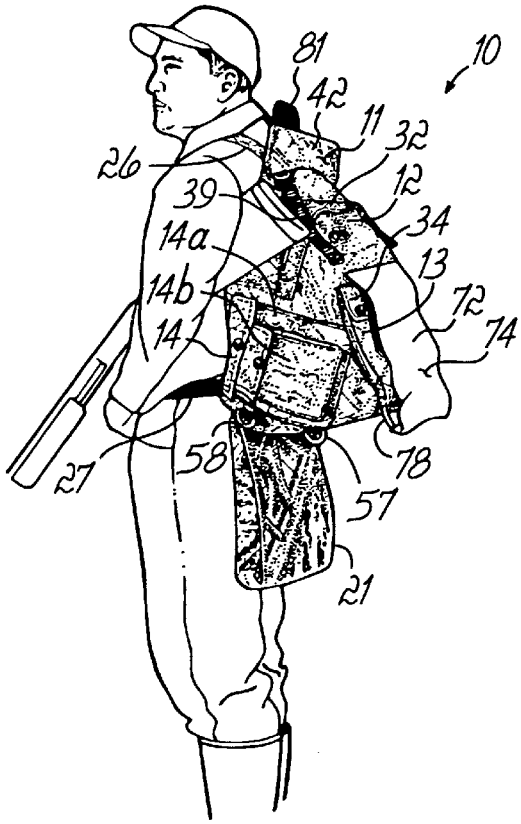
FIG. 5 is a line illustration showing the backpack lounge invention herein mounted on a hunter for carrying, showing the orange safety panel unfurled and hanging down over the back of the invention, and showing the seat pad hanging (unclipped) from the lower portion of the invention.

Likewise, when the pack 10 is worn and carried, as in FIG. 5, the pockets 14, 15 slant upwardly and forwardly toward the user. They can easily be accessed by him without removing the pack 10.

Accordingly, for all three positions of the pack, the pockets 14, 15 slant upwardly and toward the user for easy access.

Figure 6:
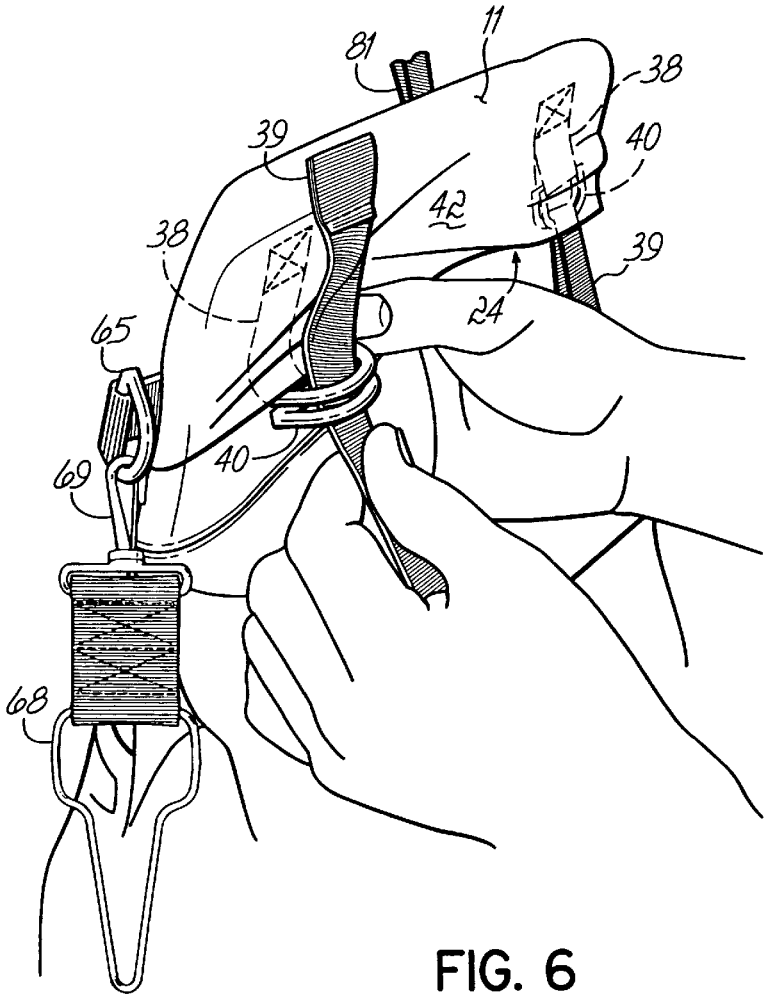
FIG. 6 is a line illustration showing the accessory straps and a game hook in place on a backpack lounge.

Other D-rings 65 (FIG. 1) and 66 (FIG. 3) are secured to an upper portion of the envelope 11 at flap 42 and are used to hang accessories such as game hook 68 (FIG. 6) by releasable clips 69 or other suitable fasteners, or can be used for other purposes.

A roll-down safety panel 72, preferably of hunter orange, is attached to pocket 12, as shown in FIG. 2, below the opening thereto. This panel can be rolled up (FIG. 1) and a camouflage selvage portion 73 covers the hunter orange portion 74. The panel 72 is held in furled condition by snapped straps 76. When unfurled (FIG. 5), however, the hunter orange portion 74 is broadly displayed for safety. Respective hook and loop fastener components 78 are secured to the outer end of panel 72 to secure that end to hook and look fastener components 79 attached to the lower end of envelope 11 to hold the panel 72 in unfurled position.

Advantages of this combination of structural features are numerous.

The large storage pocket 12 is very large and incorporates a specially designed and located zipper 31 with a weather flap 32 that is angled down each side to allow for the mouth of the pocket to open very widely.

The medium outer storage pocket 13 is located outside the large inner pocket 12 and incorporates hook and loop fasteners 35 and two adjustable straps and clips 46–48 to allow for the flap to be secured and cinched into place for small and large items.

The double layered side angular pockets 14, 15 are oriented on a forwardly opening upward angle for access from seated, recline, and upright, worn positions.

Various D-rings 57, 58, 65, 66 are placed in strategic locations to support different applications. As described, such as to support large gear such as tends, pads, clothing, maps, etc., to support the game hooks 68 and to support the added pull straps for holding other gear in place.

The hunter's safety orange panel 72 is rolled up and down and strips at each corner intended to attach to the pack when rolled out to hold in place during transfer to and from the field. The orange flap also may have camouflage wrap on the edges of the orange flap intended to cover the orange edge when rolled up and snapped into place with the snap and strap holders, 76.

The seat 21 incorporates a wedge foam pad design in order to better support the individual using the pack in a seated position. The wedge pad is made of very dense foam of any suitable manufacture in order to cushion the bumps, rocks and roots often found on the earth's floor. The foam pad slips into place through the specially-designed envelope 11. The seat pad pocket can be clipped up under the pack frame when the user is walking.

There is a two inch wide heavy weight webbing belt 27 attached at the waist level which is intended to wrap around the user's waist when the backpack is on the back of the user. This belt is adjustable and incorporates a two inch male and female buckle of any well known design to snap into place.

Dual, two inch shoulder straps 26 with soft foam padding wrap over the shoulder of a user and support the weight of the pack 10, with belt 27. The straps 26 have an adjustment (not shown) which is a pull strap intended to snug the shoulder straps tighter across the shoulders, and a chest loop 80 for holding the straps 26 together across a user's chest.

At the top of the pack there is a loop 81 of webbing material intended to act as a hang loop often found on common packs. This is to be used as a hanger of the pack on a hook, branch or other suitable support means.

The composite internal frame 16 can be disassembled for packing in a carton or bag for transporting, and the material of the envelope 11 and other components of pack 10 can be made from any suitable rugged material.

These and other modifications and advantages will be readily apparent without departing from the scope of the invention and applicant intends to be bound only by the claims appended hereto.

I claim:

1. A backpack having an internal frame comprising upper and lower frame components, storage pockets and a support pad having two positions relative to said frame components, including a seat position wherein said pad is extended away from said frame and a recline position wherein said pad is oriented alongside an upper portion of said frame, an envelope for holding said upper and lower frame components operably connected together, an inner pocket disposed over said lower frame and defined in part by said envelope, and wherein said envelope has a frame receiving opening and a top flap and wherein said inner pocket is oriented on an outer side of said envelope, said inner pocket having an access opening and supporting straps extending from said top flap to said envelope to a panel of said inner pocket.

2. A backpack as in claim 1 wherein said inner pocket access opening is defined by an upper flap and wherein said straps are releasably securable between said upper flap of said envelope and said upper flap of said inner pocket.

3. A backpack as in claim 2 further including an outer pocket disposed on an inner pocket and having an outer pocket opening wherein said outer pocket opening is defined by an upper flap and further including further support straps releasably securable over said opening from said outer pocket upper flap to lower portions of said pocket.

4. A backpack for carrying by and supporting a user in at lest three respective positions, said backpack having a frame, and a seat pad, said backpack being functional in three positions, including an upright position, a seated position and a recline position, wherein said frame has an upper component, said upper component being oriented in generally parallel position to the back of a user independently of, and for all said positions, and said frame having a lower component, an envelope covering said upper and lower components of said frame when said components are operably connected together, and wherein said seat pad extends away from said frame when said backpack is oriented in a seated position and lies adjacent said upper component of said frame when said backpack is oriented in a recline position, and lies adjacent said lower frame component when said backpack is worn on the back of a user, and further including means for securing said seat pad beneath and along said lower frame component when said backpack is worn on the back of a user.

5. A backpack as in claim 4 wherein said backpack includes a storage pocket oriented proximate one said of said upper frame component and above said lower frame component, said storage pocket defined at least in part by a portion of said envelope covering said upper frame component.

6. A backpack as in claim 5 wherein said storage pocket has a bottom panel defined by a portion of said envelope covering said lower frame component.

7. A backpack as in claim 6 wherein said envelope has an opening through which said frame components can be inserted, a flap attached to said envelope and releasably covering said opening, and a strap extending from said flap to a portion of said storage pocket for supporting said storage pocket.

8. A backpack as in claim 4 further including at least one other pocket disposed on a side of said storage pocket, said other pocket opening upwardly and forwardly of said backpack when worn by a user, opening upwardly and forwardly of said backpack when a user is seated on said pad, and opening upwardly and forwardly with respect to a user when said backpack is in a recline position.

* * * * *